US008556132B2

(12) United States Patent
Cohen et al.

(10) Patent No.: US 8,556,132 B2
(45) Date of Patent: Oct. 15, 2013

(54) INLET FOR PUMP

(75) Inventors: Ben Z. Cohen, New York, NY (US); Nigel B. Kelly, Rye Brook, NY (US)

(73) Assignee: Ben Z. Cohen, New York, NY (US)

( * ) Notice: Subject to any disclaimer, the term of this patent is extended or adjusted under 35 U.S.C. 154(b) by 763 days.

(21) Appl. No.: 12/526,821

(22) PCT Filed: Feb. 15, 2008

(86) PCT No.: PCT/US2008/054060

§ 371 (c)(1), (2), (4) Date: Mar. 22, 2010

(87) PCT Pub. No.: WO2008/101149

PCT Pub. Date: Aug. 21, 2008

(65) Prior Publication Data

US 2010/0221132 A1 Sep. 2, 2010

Related U.S. Application Data

(60) Provisional application No. 60/889,972, filed on Feb. 15, 2007.

(51) Int. Cl.
*B05B 11/00* (2006.01)
*B65D 47/34* (2006.01)

(52) U.S. Cl.
USPC ..... 222/382; 222/464.7; 222/377; 222/321.5

(58) Field of Classification Search
USPC ..... 222/321.5, 464.1, 464.7, 371, 382, 211, 222/377; 137/590
See application file for complete search history.

(56) References Cited

U.S. PATENT DOCUMENTS

| | | | | | |
|---|---|---|---|---|---|
| 2,174,354 | A | * | 9/1939 | Shields | 222/464.7 |
| 2,187,793 | A | * | 1/1940 | Rice | 138/46 |
| 2,996,073 | A | * | 8/1961 | Wolsh | 137/172 |
| 4,046,495 | A | | 9/1977 | Grimm, Jr. | |
| 4,972,977 | A | | 11/1990 | Moss et al. | |
| 5,348,194 | A | | 9/1994 | Mascitelli et al. | |
| 5,476,198 | A | * | 12/1995 | Jouillat et al. | 222/328 |
| 5,620,113 | A | * | 4/1997 | Meshberg | 222/1 |
| 6,112,945 | A | * | 9/2000 | Woods | 222/1 |
| 2002/0148860 | A1 | * | 10/2002 | Cohen et al. | 222/321.7 |
| 2004/0266423 | A1 | * | 12/2004 | Morikawa et al. | 455/424 |
| 2006/0131342 | A1 | * | 6/2006 | Bougamont et al. | 222/321.2 |

FOREIGN PATENT DOCUMENTS

| | | | | |
|---|---|---|---|---|
| EP | 0 852 210 | A2 | | 7/1998 |
| WO | 2000/004998 | A1 | | 2/2000 |
| WO | WO 00/04998 | | * | 2/2000 |
| WO | 2007009643 | A1 | | 1/2007 |

* cited by examiner

*Primary Examiner* — Paul R Durand
*Assistant Examiner* — Charles P Cheyney
(74) *Attorney, Agent, or Firm* — Hoffmann & Baron, LLP

(57) ABSTRACT

An inlet for a pump is provided herein including a first elongated component and a tubular second elongated component disposed coaxially about the first elongated component so as to define a space therebetween. Advantageously, with the subject invention, an inlet for a pump can be provided which can be modularly formed from components. In this manner, the components can be manufactured, e.g., by molding, and assembled with a pump, thereby avoiding the difficulties associated with the manufacture and assembly of dip tubes.

6 Claims, 3 Drawing Sheets

INLET FOR PUMP

BACKGROUND OF THE INVENTION

In most contemporary hand-operated pump dispensers, a flowable product is enclosed within a base container, and a hand operated pump or finger pump is connected to the container for dispensing the product. Typically, the pump communicates with the container through a dip tube or fluid conduit. One problem with such a design, particularly when applied to small dosage amounts, is that it requires a very narrow dip tube, which is difficult to manufacture and assemble to the pump. A dip tube is typically extruded from a pliable plastic, and, because of the small dimensions associated with the dip tube, it is often difficult to make, handle and mount to the pump mechanism.

SUMMARY OF THE INVENTION

The present invention is directed to an inlet for a pump. Although the inlet can be used in various settings, including conveying large amounts of flowable material, it is particularly well-suited to supply product in small dosage settings.

An inlet for a pump is provided herein including a first elongated component and a tubular second elongated component disposed coaxially about the first elongated component so as to define a space therebetween. Advantageously, with the subject invention, an inlet for a pump can be provided which can be modularly formed from components. In this manner, the components can be manufactured, e.g., by molding, and assembled with a pump, thereby avoiding the difficulties associated with the manufacture and assembly of dip tubes.

DETAILED DESCRIPTION

An inlet for a pump is described herein in accordance with present invention. The disclosed inlet is for delivering liquid, gels, slurries, and other flowable materials to a pump. It is particularly well-suited for conveying small doses of flowable material to a pump. Advantageously, the inlet can be used for ophthalmic pump applications, where small doses may be desired.

Figure 1:
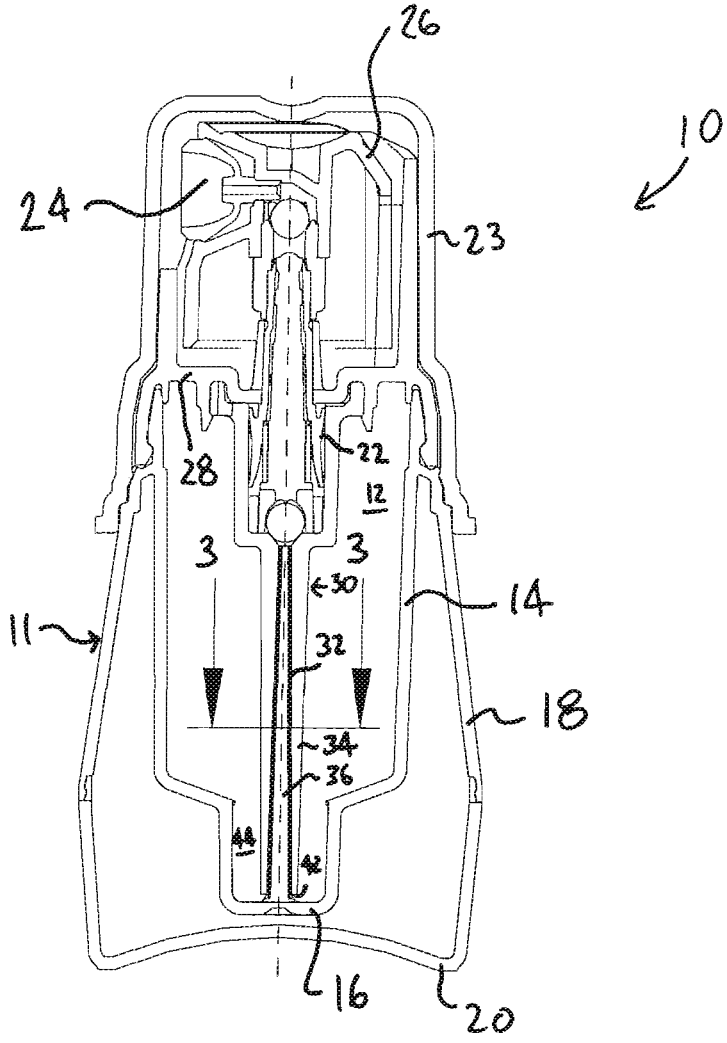
FIG. 1 is a schematic of a pump incorporating the subject invention.

With reference to FIG. 1, a pump 10 is depicted, which can be of various configurations. For illustrative purposes, the pump 10 is depicted with a specific configuration.

As will be recognized by those skilled in the art, other pump configurations are usable in connection with the subject invention. The pump 10 can be of any known design requiring an inlet for a flowable material. The pump 10 includes a pump body 11 defining a fluid reservoir 12 to accommodate a select flowable material. The reservoir 12 is at least partially bounded by an inner wall 14 and a base 16. The reservoir 12 can be adapted with various configurations and to contain various amounts of flowable material.

As shown in FIG. 1, with the reservoir 12 handling a relatively small capacity, an engagement wall 18 may be provided, sized and shaped to be comfortably handled by a user. The engagement wall 18 is formed to encircle the inner wall 14 in defining a gripping surface. Preferably, a resting base 20 may extend across the bottom of the pump 10 to close off the engagement wall 18 and to provide a stable resting surface. The resting base 20 may be disc-shaped or cup-shaped and attached to the engagement wall 18 in any known manner. Alternatively, the resting base 20 may be unitarily formed with the engagement wall 18. As a further alternative, the engagement wall 18 may be left partially or wholly open (e.g., the resting base 20 is not utilized), with an exposed bottom edge defining a resting surface for the pump 10.

With sufficiently large capacity in the reservoir 12, the engagement wall 18 need not be provided and the inner wall 14 may define a handling surface. The base 16 may also define a resting surface for the pump 10.

The pump 10 includes a pump mechanism 22 which may be of any known configuration to cause delivery of flowable material from the reservoir 12 to nozzle 24 for dispensing the flowable material. The pump mechanism 22 is mounted to the pump body 11 in any known manner. Movable actuator 26 may be associated with the pump mechanism 22 to cause actuation thereof, and the nozzle 24 may be housed in the actuator 26. Bulkhead 28 may extend across the inner wall 14 to close the reservoir 12 and to accommodate the pump mechanism 22. A removable cap 23 for storage during non-use is shown in FIG. 1, which is removed prior to use.

Figure 2:
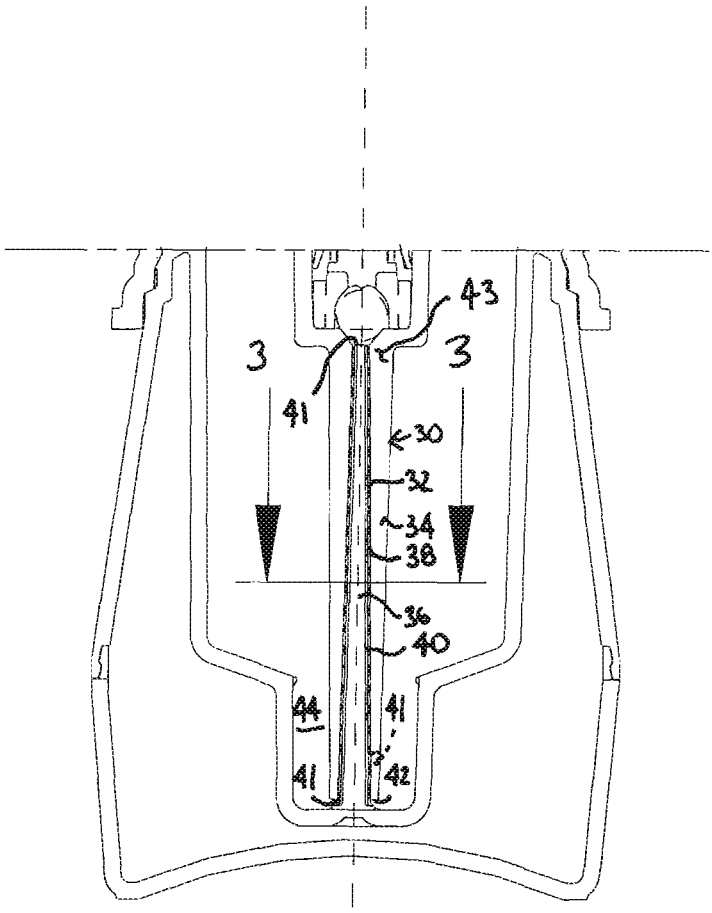
FIG. 2 is an enlarged view of the subject invention.
Figure 3:
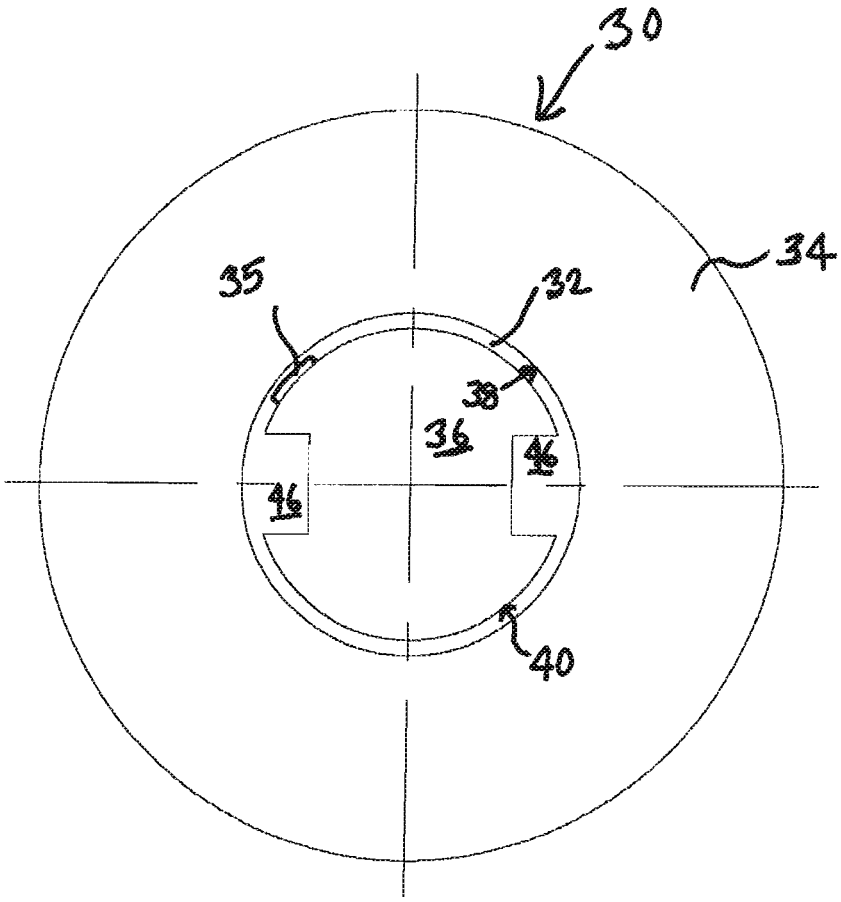
FIG. 3 is a cross-sectional view taken along lines 3-3 of FIGS. 1 and 2.

As best shown in FIGS. 2 and 3, an inlet tube 30 is provided to communicate the reservoir 12 with the pump mechanism 22. The inlet tube 30 preferably includes two or more components modularly assembled to define a space 32 that acts as a fluid passageway through the inlet tube 30. In a preferred embodiment, the inlet tube 30 is defined by two components, an outer tube 34 and a mandrel 36. The outer tube 34 is disposed coaxially about the mandrel 36 to define the space 32 therebetween. Preferably, the space 32 extends the full length of the outer tube 34.

Preferably, the components 34, 36 are rigid. As being rigid, the components 34, 36 are not pliant like a standard dip-tube, but rather set in form. The components 34, 36 may have some limited elasticity, but preferably require plastic deformation to be permanently altered in shape. It is preferred that the components 34, 36 be formed from a polymeric material, more preferably, a thermoplastic.

The outer tube 34 includes an inner surface 38 which faces the mandrel 36, while the mandrel 36 includes an outer surface 40 which faces the outer tube 34. The inner surface 38 and the outer surface 40 at least partially bound the space 32. As shown in the Figures, the inner surface 38 and the outer surface 40 can be similarly configured, e.g., to be parallel. In this manner, the space 32 may have equal thickness throughout. For example, the inner surface 38 and the outer surface 40 may be both tapered. Preferably, the inner surface 38 is formed to taper convergently from end 42 of the outer tube 34 and towards the pump mechanism 22, white the outer surface 40 is preferably formed in similar fashion. This configuration provides a larger opening at the end 42 for receiving the mandrel 36. Other configurations (e.g., non-parallel configurations) for the inner surface 38 and the outer surface 40 are possible.

The outer tube 34 may be formed unitarily with, or attached to, a portion of the pump body 11, particularly where the flow of material is desired into the pump mechanism 22. As will be appreciated by those skilled in the art, the outer tube 34 may be readily molded, particularly with the inner surface 38 being tapered. Face-to-face engagement between the outer tube 34 and the mandrel 36 may impede fluid transmission through the space 32. A longitudinal protrusion or other feature 35 (FIG. 3) may be provided on the inside of the outer tube 34 and/or the outside of the mandrel 36 which acts to minimize face-to-face engagement between the outer tube 34 and the mandrel 36. The mandrel 36 may be formed with the base 16 or formed separately therefrom and attached thereto. Again, as will be appreciated by those skilled in the art, the mandrel 36 may be readily molded, particularly if the outer surface 40 is tapered. The outer tube 34 and the mandrel 36 may be assembled easily after formation.

Advantageously, the space 32 may be defined with various dimensions, depending on the shape and positioning of the outer tube 34 and the mandrel 36. This allows for the space 32 to be relatively small to accommodate transmission of small doses. Prior art dip tubes are unitarily formed and are difficult to manufacture and assemble, particularly for small dosage volumes. The small bore of dip tubes are also difficult to purge of dust particles, which can lead to contamination of, particularly, pharmaceutical products. The space 32 can be defined to not only accommodate various dose volumes, but also to take into account characteristics of the medium being dispensed, such as viscosity.

Preferably, the end 42 of the outer tube 34 is located in proximity to the base 16. This allows the inlet tube 30 to have access to low volumes of flowable material in the reservoir 12. As shown in FIGS. 1 and 2, the base 16 may include a cup-shaped well 44 at the bottom for the reservoir 12 for maximally collecting remaining flowable material. The end 42 may be formed to extend into the well 44.

Openings 41 may be defined to provide access to the space 32. The openings 41 may be defined at the end 42 of the outer tube 34. It is preferred that the base 16 be spaced from the end 42 to provide access thereto. The mandrel 36 may extend beyond the end 42 and/or beyond opposite end 43 of the outer tube 34. Alternatively, the mandrel 36 may have a length shorter than the outer tube 34.

The openings 41 may be defined continuously or discontinuously between the outer tube 34 and the mandrel 36. In addition, or alternatively, the openings 41 may be formed as one or more apertures which extend through the outer tube 34 (as shown in dashed lines in FIG. 2).

With reference to FIG. 3, one or more channels 46 may be defined (e.g., being recessed) in the outer tube 34 and/or the mandrel 36 to define enlarged portions of the space 32. The channels 46 may extend the length of the inlet tube 30 (e.g., the length of the mandrel 36). The channels 46 ensure that the space 32 has sufficient flow area if the outer tube 34 and/or the mandrel 36 is bent or eccentrically located in the outer tube 34, thereby blocking one or more portions of the space 32.

The space 32 may have a thickness of generally 0.005 inches between the outer tube 34 and the mandrel 36 The thickness of the space 32 may be adjusted. The space 32 may have a length of generally 1.5 inches.

During use, the pump mechanism 22 will cause flowable material to be drawn from the reservoir 12 and through the inlet tube 30. As flowable material is dispensed through action of the actuator 26, the flowable material passes through the space 32 (including any of the channel(s) 46 being utilized), with additional material being drawn in through the end 42 from the reservoir 12.

What is claimed is:

1. A pump comprising:

a reservoir;

a pump mechanism; and;

an inlet for communicating said reservoir and said pump mechanism, wherein said inlet includes:

an elongated, cross-sectionally solid first component having first and second ends, said first end of said first component being non-movably fixed to a wall of said reservoir; and, a tubular second component having first and second ends disposed coaxially about said first component so as to define a space there between, said space defining a fluid passageway for communicating said reservoir and said pump mechanism, said first end of said second component being located in proximity to the wall to which said first component is mounted, wherein, said first component includes an outer surface, said outer surface of said first component being tapered convergently from said first end to said second end, wherein said second component includes an inner surface, said inner surface of said second component being tapered convergently from said first end to said second end.

2. A pump as in claim 1, wherein at least one channel is provided between said first and second components to provide said space with an enlarged portion.

3. A pump as in claim 1, wherein said first component in rigid.

4. A pump as in claim 1, wherein said second component is rigid.

5. A pump as is claim 1, wherein said space and said second component are formed coextensively with the same length.

6. A pump as in claim 1, wherein said second component is attached to said pump mechanism.

* * * * *